US010379481B2

(12) United States Patent
Ninomiya et al.

(10) Patent No.: US 10,379,481 B2
(45) Date of Patent: Aug. 13, 2019

(54) TRANSPORT DEVICE AND IMAGE FORMING APPARATUS HAVING A POWDER APPLYING DEVICE

(71) Applicant: FUJI XEROX CO., LTD., Tokyo (JP)

(72) Inventors: Yosuke Ninomiya, Kanagawa (JP); Ryuji Hattori, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/946,239

(22) Filed: Apr. 5, 2018

(65) Prior Publication Data

US 2019/0072892 A1 Mar. 7, 2019

(30) Foreign Application Priority Data

Sep. 7, 2017 (JP) ..... 2017-172102

(51) Int. Cl.

| | |
|---|---|
| ***G03G 15/16*** | (2006.01) |
| ***B65H 5/06*** | (2006.01) |
| ***B65H 5/38*** | (2006.01) |
| ***G03G 15/00*** | (2006.01) |

(52) U.S. Cl.

CPC ..... *G03G 15/6558* (2013.01); *B65H 5/062* (2013.01); *B65H 5/38* (2013.01); *G03G 15/16* (2013.01); *G03G 15/6582* (2013.01); *G03G 15/6588* (2013.01); *G03G 2215/00409* (2013.01); *G03G 2215/00523* (2013.01); *G03G 2215/00801* (2013.01)

(58) Field of Classification Search

CPC ..... G03G 15/6558

USPC ..... 399/297

See application file for complete search history.

(56) References Cited

U.S. PATENT DOCUMENTS

| | | | | |
|---|---|---|---|---|
| 8,923,712 | B1 | 12/2014 | Kiuchi et al. | |
| 9,195,167 | B2 | 11/2015 | Kiuchi et al. | |
| 9,411,263 | B2 | 8/2016 | Kiuchi et al. | |
| 9,696,680 | B2 | 7/2017 | Kawasaki et al. | |
| 2015/0072112 | A1* | 3/2015 | Kiuchi | G03G 15/0822 428/195.1 |
| 2016/0259292 | A1* | 9/2016 | Kawasaki | G03G 15/161 |
| 2016/0320719 | A1 | 11/2016 | Kiuchi et al. | |
| 2016/0320736 | A1 | 11/2016 | Kiuchi et al. | |
| 2017/0192728 | A1 | 7/2017 | Someya | |

FOREIGN PATENT DOCUMENTS

| | | | |
|---|---|---|---|
| JP | 2015-011047 | A | 1/2015 |
| JP | 2016-008978 | A | 1/2016 |
| JP | 2016-113253 | A | 6/2016 |
| JP | 2016-132466 | A | 7/2016 |
| JP | 2016-133564 | A | 7/2016 |

(Continued)

*Primary Examiner* — Walter L Lindsay, Jr.
*Assistant Examiner* — PhilipMarcus T Fadul
(74) *Attorney, Agent, or Firm* — Sughrue Mion, PLLC

(57) ABSTRACT

A transport device includes a powder applying device and a guidance member. The powder applying device is provided in a guide path through which a sheet is guided toward an image holding body holding a toner image to be transferred onto the sheet, and applies powder to end portions of the sheet in a transport direction. The guidance member is provided on a side facing the powder applying device in the guide path, and guides the sheet being transported through the guide path to the powder applying device.

17 Claims, 9 Drawing Sheets

(56) References Cited

FOREIGN PATENT DOCUMENTS

| | | | |
|---|---|---|---|
| JP | 2016-133565 | A | 7/2016 |
| JP | 2016-161853 | A | 9/2016 |
| JP | 2016-181103 | A | 10/2016 |

* cited by examiner

TRANSPORT DEVICE AND IMAGE FORMING APPARATUS HAVING A POWDER APPLYING DEVICE

CROSS-REFERENCE TO RELATED APPLICATIONS

This application is based on and claims priority under 35 USC 119 from Japanese Patent Application No. 2017-172102 filed Sep. 7, 2017.

BACKGROUND

Technical Field

The present invention relates to a transport device and an image forming apparatus.

SUMMARY

According to an aspect of the present invention, there is provided a transport device that includes a powder applying device and a guidance member. The powder applying device is provided in a guide path through which a sheet is guided toward an image holding body holding a toner image to be transferred onto the sheet, and applies powder to end portions of the sheet in a transport direction. The guidance member is provided on a side facing the powder applying device in the guide path, and guides the sheet being transported through the guide path to the powder applying device.

BRIEF DESCRIPTION OF THE DRAWINGS

Exemplary embodiments of the present invention will be described in detail based on the following figures, wherein.

DETAILED DESCRIPTION

First Exemplary Embodiment

A transport device and an image forming apparatus according to a first exemplary embodiment is described.

Overall Structure

Figure 1:
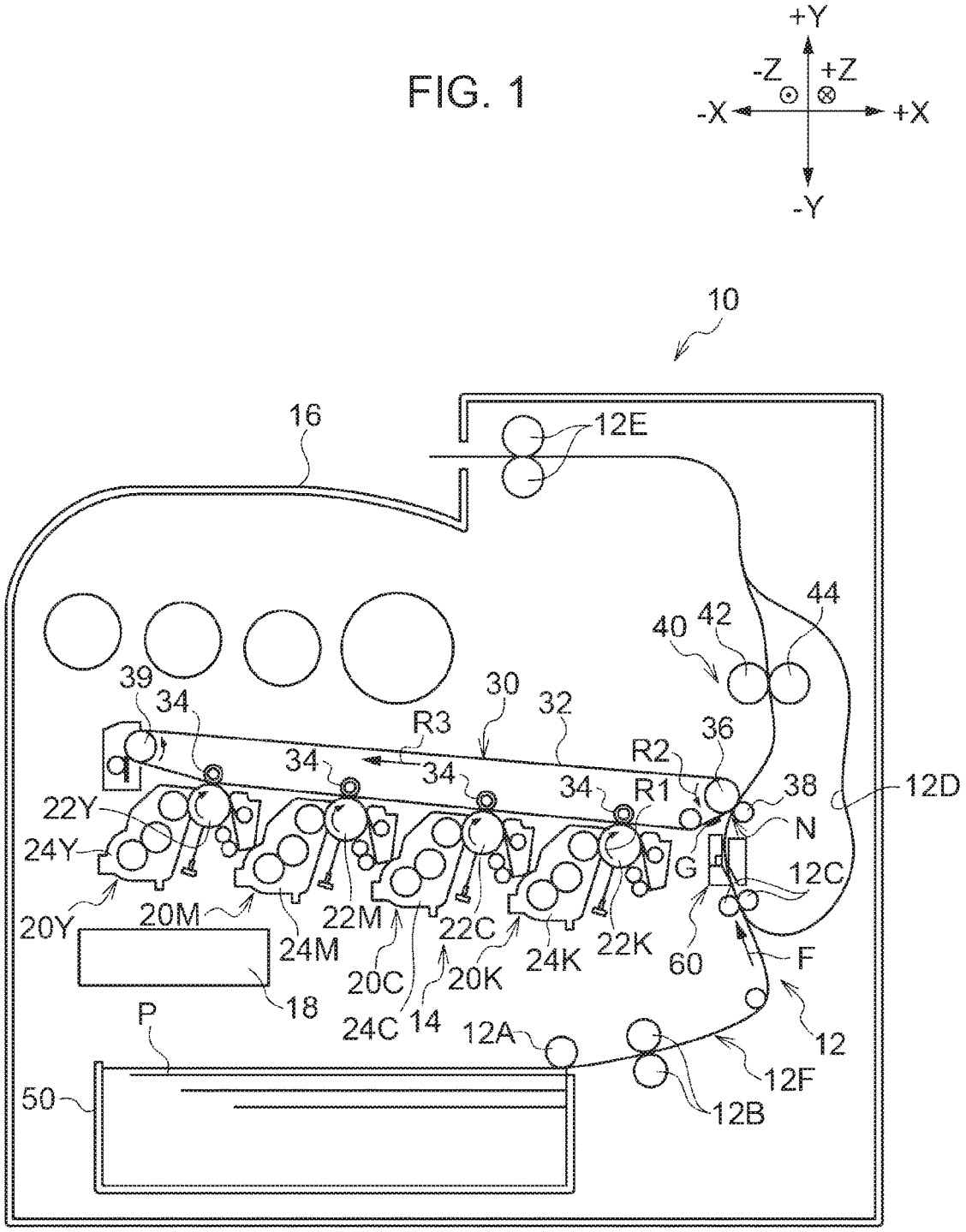
FIG. 1 is a structural view (front view) of an image forming apparatus according to a first exemplary embodiment.

FIG. 1 illustrates an image forming apparatus 10 that includes a transport unit 12 serving as an example of the transport device according to the present exemplary embodiment. In the following description, in front view of the image forming apparatus 10, the apparatus width direction, the apparatus height direction, and the apparatus depth direction are respectively referred to as the X direction, the Y direction, and the Z direction. Furthermore, when it is required that one side and the other side are distinguished from each other in each of the X direction, the Y direction, and the Z direction, in front view of the image forming apparatus 10, the upper side is referred to as the +Y side, the lower side is referred to as the −Y side, the right side is referred to as the +X side, the left side is referred to as the −X side, the rear side is referred to as the +Z side, the front side is referred to as the −Z side.

The image forming apparatus 10 includes the transport unit 12, an image forming section 14, and a fixing device 40. The transport unit 12 transports sheets of recording paper. Each of these recording sheets serves as an example of recording medium. The image forming section 14 forms with toner images G on the recording sheet transported by the transport unit 12. The fixing device 40 applies heat and pressure to the toner images G so as to fix the toner images G onto the recording sheet. According to the present exemplary embodiment, the toner images G are formed on label sheets of paper P. Each of these label sheets P serves as the recording medium instead of the recording sheet. The details of the label sheet P will be described later. The following description describes the case where the label sheet P is used as the recording medium.

As illustrated in FIG. 1, the image forming section 14 includes image forming units 20Y, 20M, 20C, and 20K and a transfer unit 30. Here, yellow (Y), magenta (M), cyan (C), and black (K) are examples of toner colors. Furthermore, the image forming section 14 includes a controller 18 that controls operation of components of the image forming units 20 to cause the toner images G to be formed on the label sheet P. The image forming units 20 perform charging, exposing, developing, and transfer steps of a known electrophotographic method as an example. In the following description, the suffixes Y, M, C, and K of the image forming units 20Y, 20M, 20C, and 20K and components included therein are omitted when distinction in accordance with the toner colors (Y, M, C, and K) is not required.

The image forming units 20 include respective photosensitive drums 22 and respective developing devices 24.

The photosensitive drums 22 have a function of holding the toner images G developed by the developing devices 24. Here, on outer circumferential surfaces of the photosensitive drums 22Y, 22M, 22C, and 22K, the toner images G of the respective colors, that is, yellow (Y), magenta (M), cyan (C), and the black (K) are formed. The photosensitive drums 22 each have a cylindrical shape and are each rotated about its own axis (in an arrow R1 direction) by a drive device (not illustrated). The photosensitive drum 22 includes, for example, an aluminum base material and a photosensitive layer (not illustrated). The photosensitive layer includes an undercoating layer, a charge production layer, and a charge transport layer formed in this order on the base material.

The developing devices 24 have a function of developing electrostatic latent images formed on the photosensitive drums 22 into the respective toner images G. The developing devices 24 each extends in the axial direction of the photosensitive drum 22.

The transfer unit 30 has a function of transferring through second transfer the toner images G of the respective colors onto the label sheet P after the toner images G that had been developed on the outer circumferential surfaces of the photosensitive drums 22 by the developing devices 24 have been transferred through first transfer. The transfer unit 30 includes a transfer belt 32, first transfer rollers 34 for the respective colors, a drive roller 36, and a second transfer roller 38. Here, the transfer belt 32 is an example of an image holding body that holds the toner images G.

The transfer belt 32 is an endless belt. The first transfer rollers 34 and the drive roller 36 are disposed so as to be in contact with an inner circumferential surface of the transfer belt 32. The orientation of the transfer belt 32, which is inclined relative to the apparatus width direction in front view, is determined by rollers in contact with the inner circumferential surface of the transfer belt 32, that is, the four first transfer rollers 34, the drive roller 36, a tension applying roller 39, and so forth. The outer circumferential surfaces of the photosensitive drums 22 of the image forming units 20 arranged in a direction inclined relative to the apparatus width direction are in contact with a portion of an outer circumferential surface of the transfer unit 30 facing the lower side in the apparatus height direction. As illustrated in FIG. 1, when the drive roller 36 is rotated in an arrow R2 direction, the transfer belt 32 is rotated in an arrow R3 direction.

A first transfer voltage is applied to the first transfer rollers 34, thereby transferring through first transfer the toner images G formed on the outer circumferential surfaces of the photosensitive drums 22Y, 22M, 22C, and 22K onto the outer circumferential surface of the transfer belt 32.

The second transfer roller 38 has an elongated shape. The second transfer roller 38 is pressed by a pressure device (not illustrated) during image forming operation, thereby a nip N is formed between the second transfer roller 38 and the transfer belt 32. A second transfer voltage is applied to the second transfer roller 38, thereby transferring through second transfer the toner images G having been transferred through first transfer onto the outer circumferential surface of the transfer belt 32 onto the label sheet P transported by the transport unit 12 and passing through the nip N.

The transport unit 12 has a function of transporting the label sheets P contained in a containing unit 50 toward an output unit 16. The transport unit 12 includes a feed roller 12A, a transport roller pair 12B, a transport roller pair 12C, an inversion transport unit 12D, and output rollers 12E. The transport unit 12 also includes a guide unit 60 in a transport path 12F from the transport roller pair 12C to the nip N. The label sheet P is transported in a transport direction F through the transport path 12F. The structures of the transport path 12F and the guide unit 60 will be described later.

The fixing device 40 has a function of fixing onto the label sheet P the toner images G transferred through second transfer onto the label sheet P. The fixing device 40 includes a fixing roller 42 and a pressure roller 44.

The Label Sheet

Figure 2A:
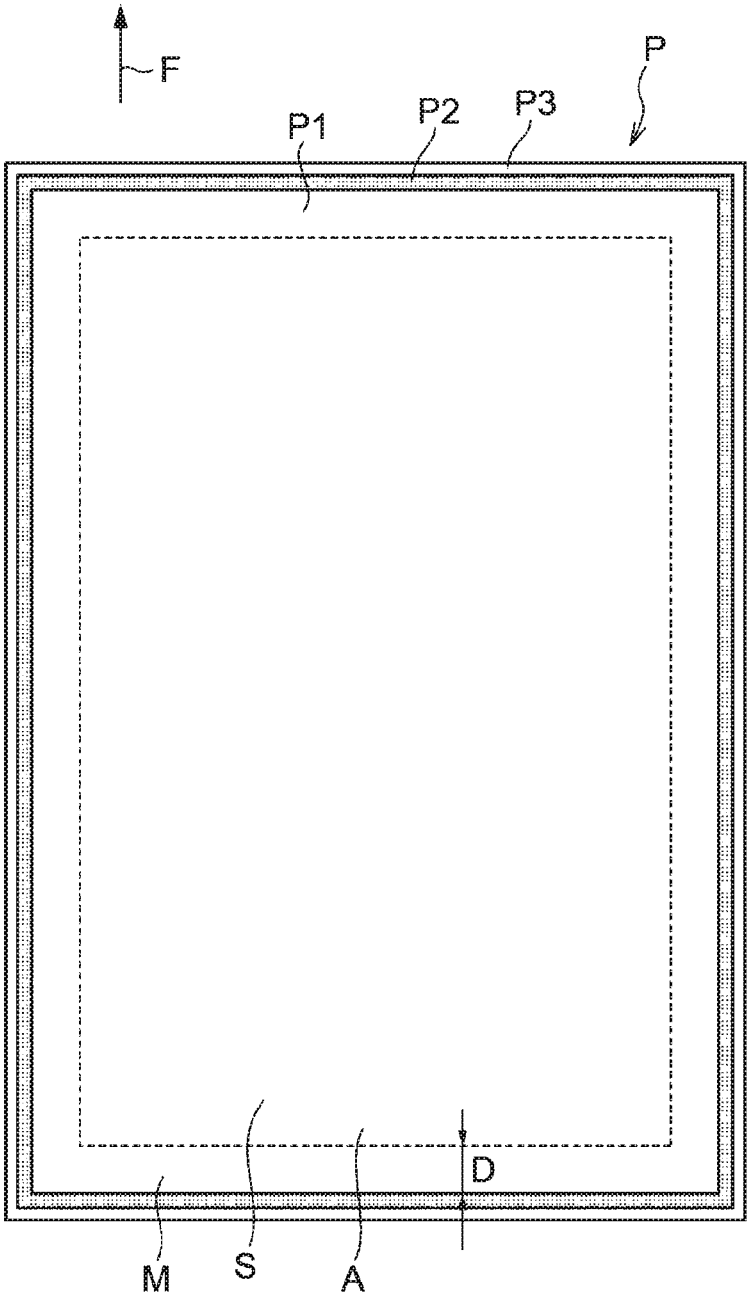
FIGS. 2A and 2B are respectively a plan view and a side view of a label sheet used with the image forming apparatus according to the first exemplary embodiment.
Figure 2B:
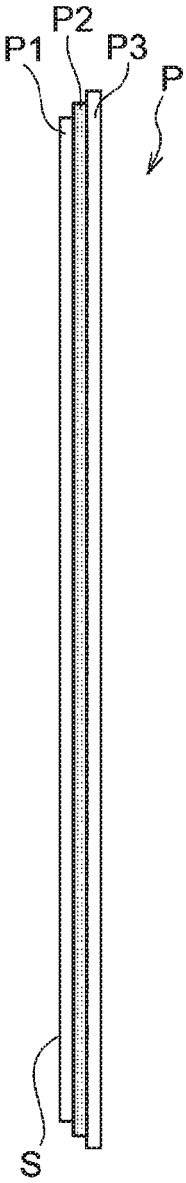

The image forming apparatus 10 according to the present exemplary embodiment is able to form images on the label sheet P serving as an example of the recording medium. As illustrated in FIGS. 2A and 2B, the label sheet P includes a surface material P1, a tacky layer P2, and release paper P3. The toner images G are transferred (images are formed) onto the surface of the surface material P1. The tacky layer P2 includes glue applied to a rear surface of the surface material P1. The release paper P3 is pasted on the tacky layer P2. Furthermore, a transfer surface S is set as a surface onto which the toner images G are transferred in the surface material P1 of the label sheet P. Furthermore, the transfer surface S has an image forming region A where the images are formed and margins M where no image is formed. Examples of the margins M include, for example, a region where the toner images G are not able to be transferred, a region where the quality of the images formed therein is not guaranteed, and a region set by the controller 18. The label sheet P is an example of a sheet. An end portion of the label sheet P on the downstream side in the transport direction F is defined as a leading end and an end portion of the label sheet P on the upstream side in the transport direction F is defined as a trailing end.

Here, the tacky layer P2 may extend outward past the surface material P1 depending on the state of cutting of the label sheet P when the label sheet P is formed. Furthermore, the release paper P3 may be shifted relative to the tacky layer P2 due to warpage of the label sheet P during transportation. This may also cause the tacky layer P2 to extend outward past the surface material P1.

Examples of the surface material P1 include fine paper, kraft paper, and recycled paper, and so forth. Examples of the glue applied to the tacky layer P2 include a variety of adhesives such as an acrylic adhesive, a polyester adhesive, a urethane adhesive, a silicone adhesive, a natural rubber adhesive, and a synthetic rubber adhesive.

Structures

Next, the transport path 12F and the guide unit 60 are described.

Figure 3:
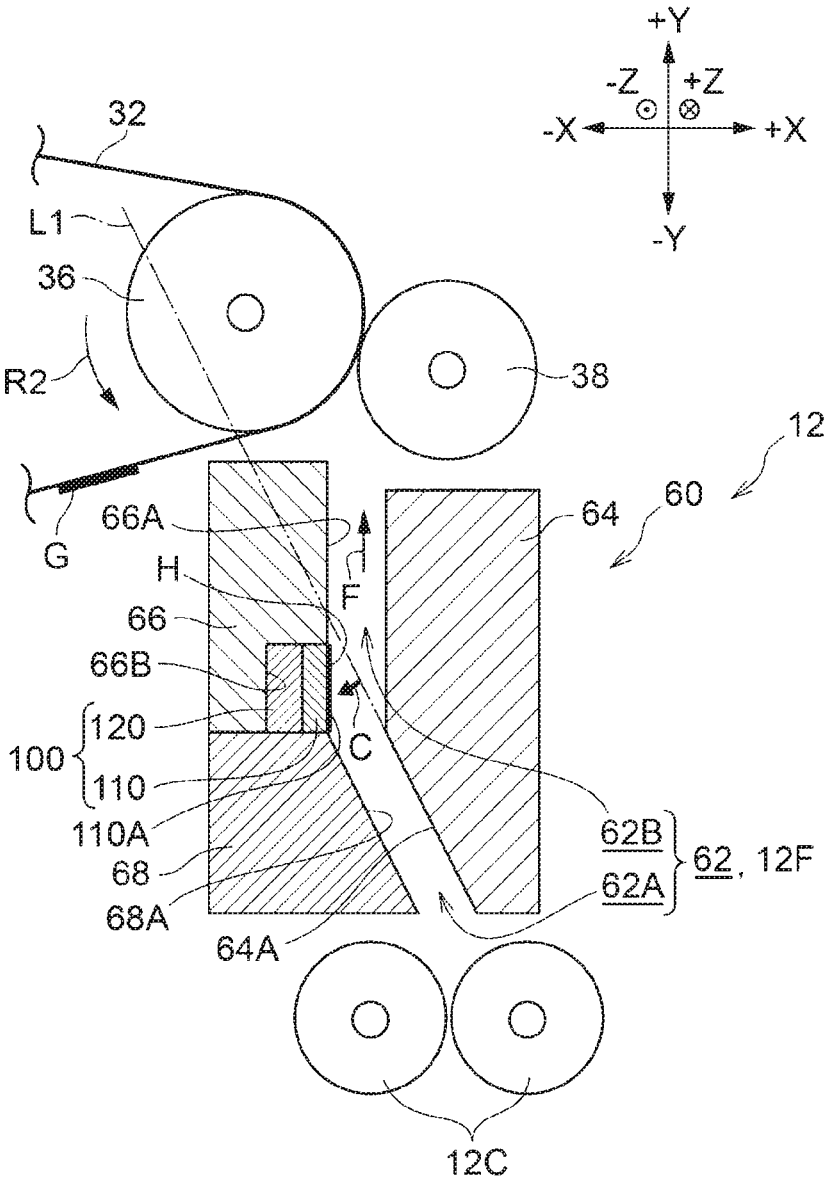
FIG. 3 is a structural view (side view) of a transport device according to the first exemplary embodiment.

FIG. 3 illustrates the guide unit 60 provided in the transport path 12F from the transport roller pair 12C to the nip N. The guide unit 60 includes a powder applying device 100, a guidance member 64, a first guide member 66 serving as an example of a regulating member, and a second guide member 68 serving as an example of another regulating member.

According to the present exemplary embodiment, a guide path 62 is defined by the guidance member 64 and the first and second guide members 66 and 68 that face the guidance member 64. This guide path 62 has a function of guiding the label sheet P toward the transfer belt 32 serving as an example of the image holding body that holds the toner images G. The guide path 62 forms part of the transport path 12F. The guide path 62 has an inclined path 62A and a vertical path 62B. In sectional view seen from the +Z side, the inclined path 62A extends from the transport roller pair 12C provided on the −Y side toward a position on the +Y side of the −X side, and the vertical path 62B extends from an end portion of the inclined path 62A on the +Y side toward the +Y side.

The powder applying device 100 is provided in the guide path 62. Specifically, the powder applying device 100 is provided at a corner portion of the first guide member 66 on the +X side of the −Y side of the first guide member 66 and has a function of applying powder H to the leading end or the trailing end of the label sheet P. The structure of the powder applying device 100 will be described later.

The guidance member 64 is an elongated member having a substantially trapezoidal section in sectional view seen from the +Z side. The guidance member 64 has a function of guiding the label sheet P transported through the inclined path 62A toward the powder applying device 100. The guidance member 64 may be a single elongated member extending in the Z direction or include plural elongated members disposed in the Z direction. Here, the guidance member 64 has an inclined surface 64A that extends from the transport roller pair 12C provided on the −Y side toward a position on the +Y side of the −X side. The inclined surface 64A defines the inclined path 62A. The leading end of the label sheet P is guided through the inclined surface 64A.

The first guide member 66 is provided at a position on the side facing the guidance member 64 and adjacent to and downstream of the powder applying device 100 in the transport direction F. The first guide member 66 is an elongated member having a rectangular cut portion 66B at a corner portion on the +X side of the −Y side thereof in sectional view seen from the +Z side. The first guide member 66 has a function of regulating contact between the transfer surface S of the label sheet P and the powder applying device 100. The first guide member 66 may be a single elongated member extending in the Z direction or include plural elongated members disposed in the Z direction.

Here, the first guide member 66 has a contact surface 66A extending in the Y direction. The contact surface 66A defines the vertical path 62B. The label sheet P is brought into contact with the contact surface 66A. Furthermore, the powder applying device 100 is contained in the cut portion 66B of the first guide member 66.

The second guide member 68 is provided at a position on the side facing the guidance member 64 and adjacent to and upstream of the powder applying device 100 in the transport direction F. The second guide member 68 has a function of regulating contact between the powder applying device 100 and the transfer surface S of the label sheet P. The second guide member 68 is an elongated member having a trapezoidal section in sectional view seen from the +Z side, projecting further to the guidance member 64 side than the first guide member 66. The second guide member 68 may be a single elongated member extending in the Z direction or include plural elongated members disposed in the Z direction. Here, the second guide member 68 has an inclined surface 68A that extends from the transport roller pair 12C provided on the −Y side toward a position on the −X side of the +Y side. The inclined surface 68A defines the inclined path 62A. The label sheet P is brought into contact with the inclined surface 68A. The length of the side of the second guide member 68 at the end portion on the +Y side is equal to the length of the first guide member 66 in the X direction.

The powder applying device 100 according to the present exemplary embodiment is provided in the width direction of the label sheet P (Z direction) in the cut portion 66B of the first guide member 66 and includes a contact portion 110 able to be brought into contact with the label sheet P and a storing portion 120 in which the powder H is stored. The contact portion 110 is an elongated member having a rectangular section when seen in the width direction of the label sheet P (Z direction) and has a length in the width direction of the label sheet P (Z direction) equal to or larger than that of the label sheet P. The contact portion 110 is exposed in the guide path 62 (vertical path 62B) at the surface thereof on the guidance member 64 side and connected to the storing portion 120 on the opposite surface thereof to the guidance member 64. As illustrated in FIG. 3, the powder H is held on a flat surface 110A of the contact portion 110 on the +X side. Here, the flat surface 110A is an example of a contact surface. Furthermore, the storing portion 120 is an elongated member having a rectangular section when seen in the width direction of the label sheet P (Z direction) and has a substantially equal length in the width direction of the label sheet P (Z direction) to that of the contact portion 110. The storing portion 120 is contained in the cut portion 66B.

The contact portion 110 and the storing portion 120 included in the powder applying device 100 according to the present exemplary embodiment are each formed of a sponge having an open cell structure and serving as a porous elastic body. Although the contact portion 110 and the storing portion 120 are separately formed of respective sponges according to the present exemplary embodiment, the contact portion 110 and the storing portion 120 may be formed of an integrated sponge. In this case, the contact portion 110 also functions as the storing portion 120. Furthermore, the contact portion 110 may be formed of brush-shaped fiber member instead of a sponge having an open cell structure.

Examples of the powder H applied to the leading end or the trailing end of the label sheet P by the powder applying device 100 include, for example, silica, polymethyl methacrylate (PMMA), zinc stearate (ZnSt), calcium carbonate, and talc. The particle size (number-average particle size) of the powder H may be set to be, for example, from 0.5 to 14 μm. When the particle size of the powder H is smaller than 0.5 μm, the powder H is likely to be sunk into the tacky layer P2 of the label sheet P. Thus, it may be difficult to maintain the degree of suppression of the adherence of the glue. When the particle size of the powder H is larger than 14 μm, an initial degree of suppression of the adherence of the glue may tend to be smaller than a required degree of suppression. In addition to the above-described examples, the examples of the powder H may include a yellow (Y) toner and a clear toner.

In the guide unit 60 having the above-described structure, the powder applying device 100 is disposed so as to satisfy the following three conditions.

Condition 1

When seen in the width direction of the label sheet P (Z direction), the contact portion 110 of the powder applying device 100 is formed at a position farther from the guidance member 64 (see an arrow C) than an extended line L1 extended from the inclined surface 64A toward the first guide member 66 (see FIG. 3), that is, formed on the −X side of the —Y side. This condition 1 determines an appropriate position of the contact portion 110 when the leading end of the label sheet P is in contact with the first guide member 66 (see FIG. 5B).

Condition 2

Figure 4:
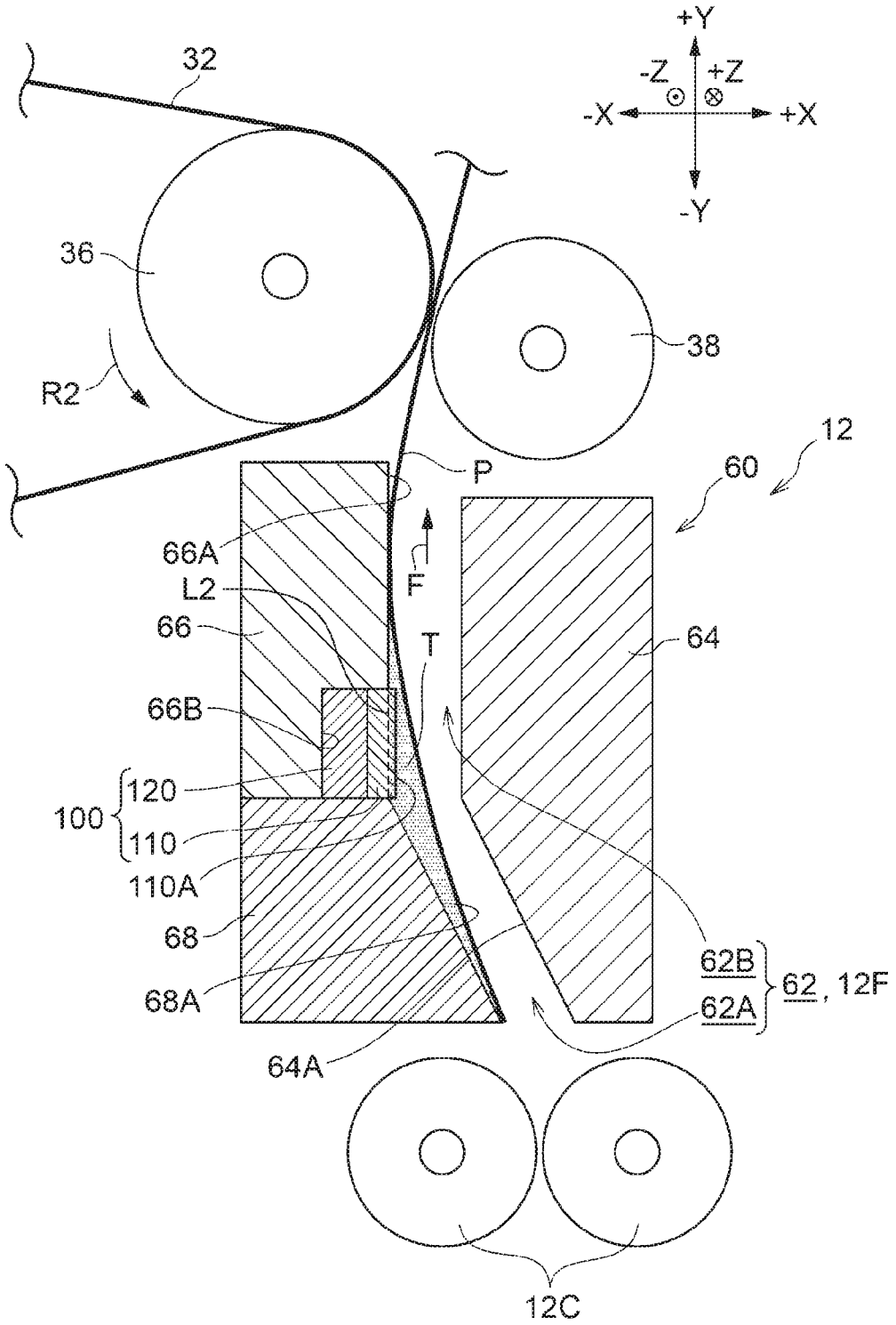
FIG. 4 illustrates the transport device according to the first exemplary embodiment, explaining disposition of a contact portion of a powder applying device.

As illustrated in FIG. 4, when seen in the width direction of the label sheet P (Z direction), the flat surface 110A of the contact portion 110 of the powder applying device 100 for the label sheet P is disposed inside a substantially triangular region T defined by the first guide member 66, the second guide member 68, and the label sheet P. Specifically, the region T is defined by an extended line L2 extended from the contact surface 66A of the first guide member 66 toward the second guide member 68, the inclined surface 68A of the second guide member 68, and the label sheet P in contact with the contact surface 66A and the inclined surface 68A. Here, the inclined surface 68A of the second guide member 68 is an example of an outer line of another regulating member. This condition 2 determines an appropriate position of the contact portion 110 when the trailing end of the label sheet P is separated from the transport roller pair 12C (see FIG. 6A).

Condition 3

The length of the contact portion 110 in the transport direction F (Y direction) is equal to or smaller than a length D (see FIG. 2A) of one of the margins M on the trailing end side of the label sheet P. This condition 3 determines an appropriate dimension of the contact portion 110 when the trailing end of the label sheet P is separated from the second guide member 68 (see FIG. 6B).

Operations

As described above, the tacky layer P2 may extend outward past the surface material P1 in the label sheet P (see FIGS. 2A and 2B). That is, the glue may extend outward to an outer peripheral portion of the transfer surface S of the label sheet P. When the label sheet P in the above-described state enters the nip N, the glue may adhere to the transfer belt 32. In view of the above-described situation, the image forming apparatus 10 that includes the transport unit 12 according to the present exemplary embodiment may suppress adhering of the glue to the transfer belt 32 during image formation on the label sheet P. Operations according to the present exemplary embodiment are described below with reference to FIGS. 5A to 5C and 6A and 6B.

Figure 5A:
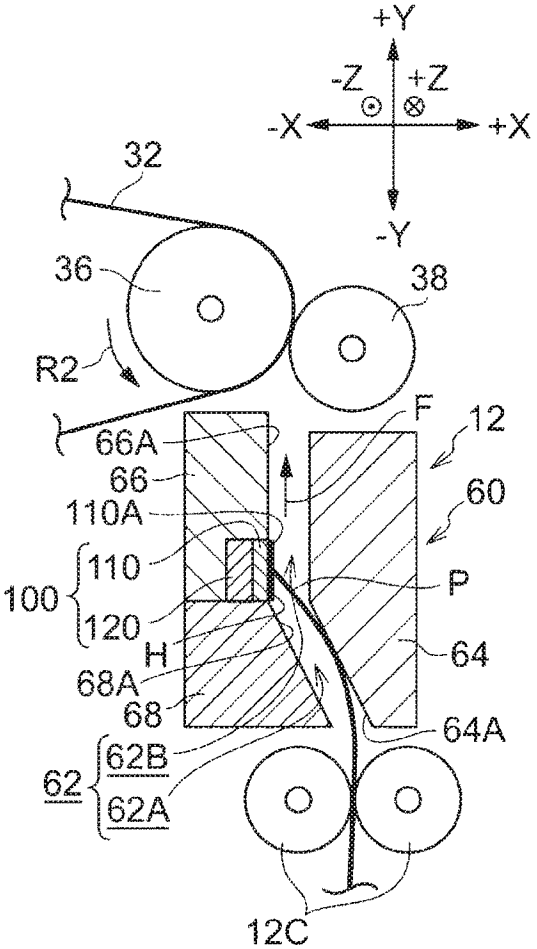
FIGS. 5A, 5B, and 5C explain operation of the transport device according to the first exemplary embodiment.

As illustrated in FIG. 5A, when the label sheet P transported from the transport roller pair 12C toward the guide unit 60 in the Y direction enters the guide path 62, first, the leading end of the label sheet P is brought into contact with the inclined surface 64A of the guidance member 64. This changes the transport direction F from a direction toward the +Y side to a direction toward the −X side of the +Y side. As a result, the label sheet P is transported toward the powder applying device 100. Then, the leading end of the label sheet P is brought into contact with the powder applying device 100. Specifically, the leading end of the label sheet P is brought into contact with the contact portion 110 of the powder applying device 100 exposed in the guide path 62. This causes the powder H contained in the contact portion 110 or held on the flat surface 110A to adhere to the glue extending outward to the leading end of the label sheet P. As described above, according to the present exemplary embodiment, compared to a structure with which the powder H is not applied to the leading end of the label sheet P, exposure of the glue may be suppressed. Accordingly, adhering of the glue to the transfer belt 32 may be suppressed.

Furthermore, the contact portion 110 being an elastic body is elastically deformed when the contact portion 110 is brought into contact with the leading end of the label sheet P. This allows the label sheet P to be fed in the transport direction F (+Y side) without obstructing a movement of the label sheet P. That is, according to the present exemplary embodiment, compared to a structure in which the contact portion 110 is not deformed or displaced, the likelihood of the label sheet P being caught by the contact portion 110 when the label sheet P is brought into contact with the contact portion 110 may be reduced. The contact portion 110 is brought into contact with the label sheet P. This causes the contact portion 110 and the storing portion 120 connected to the −X side of the contact portion 110 to be elastically deformed, thereby the powder H contained in the storing portion 120 is supplied to the contact portion 110. That is, the storing portion 120 is able to supply the powder H when the contact portion 110 is a sponge having an open cell structure and serving as an example as a porous elastic body. According to the present exemplary embodiment, compared to a structure that is not provided with the storing portion 120, shortage in supply of the powder H may be suppressed.

Figure 5B:
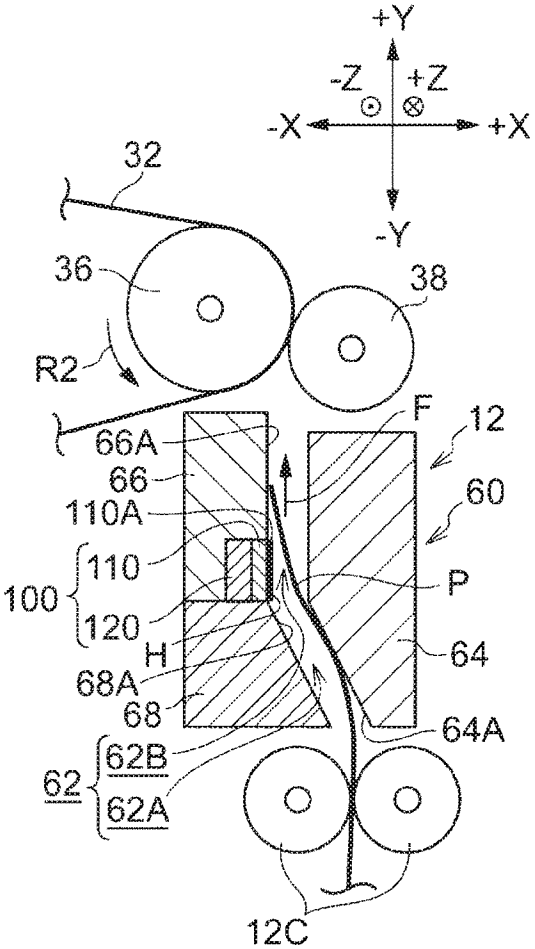

When the label sheet P is transported in the transport direction F, the leading end of the label sheet P is brought into contact with the contact surface 66A of the first guide member 66 in the vertical path 62B as illustrated in FIG. 5B. At this time, the label sheet P continues to be transported by the transport roller pair 12C, and a rear side of the label sheet P (release paper P3) is still in contact with the inclined surface 64A in the inclined path 62A. Then, when the leading end of the label sheet P reaches the vertical path 62B, the transport direction F of the label sheet P is changed by the first guide member 66 from the −X side of the +Y side to the +Y side, thereby the transfer surface S is separated from the contact portion 110. That is, according to the present exemplary embodiment, compared to a structure that is not provided with the first guide member 66, adhering of the powder H to the transfer surface S of the label sheet P may be suppressed.

Here, when the contact portion 110 projects toward the guidance member 64 side (+X side) relative to the contact surface 66A, compared to the case where the contact portion 110 does not project in such a manner, the powder H may reliably adhere to the glue extending outward at the leading end of the label sheet P. When the contact portion 110 excessively projects toward the guidance member 64 (+X side) relative to the contact surface 66A, that is, the contact portion 110 excessively projects in the guide path 62 (vertical path 62B), the powder H may adhere to the transfer surface S of the label sheet P. Accordingly, as described above as the condition 1, when seen in the width direction of the label sheet P (Z direction), the contact portion 110 may be disposed farther from the guidance member 64 (see the arrow C) than the extended line L1 extended from the inclined surface 64A toward the first guide member 66. This allows the contact portion 110 to be separated from the label sheet P transported toward the guide path 62 (vertical path 62B) compared to the case where the contact portion 110 is disposed closer to the guidance member 64 than the extended line L1. Thus, adhering of the powder H to the transfer surface S of the label sheet P may be suppressed.

Figure 5C:
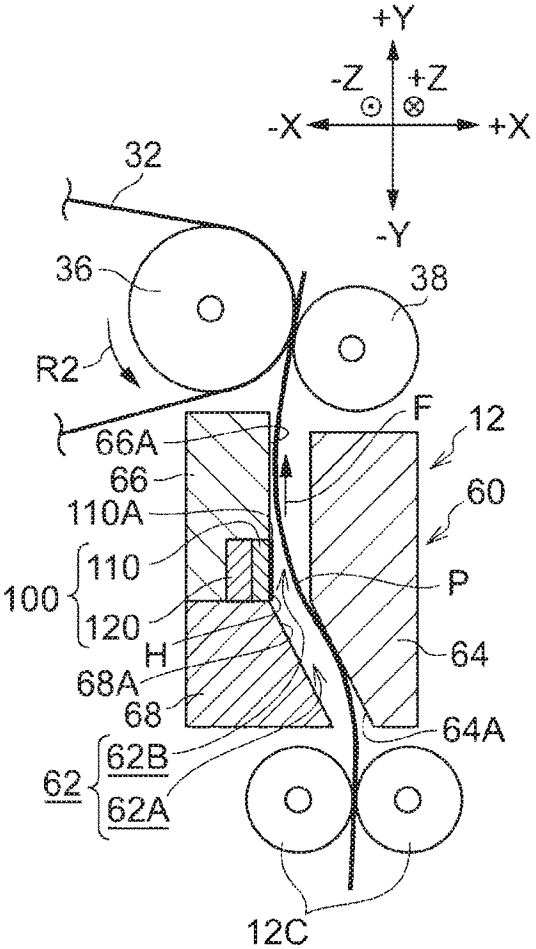

When the label sheet P is transported further in the transport direction F, the leading end of the label sheet P is inserted into the nip N as illustrated in FIG. 5C. At this time, the label sheet P continues to be transported by the transport roller pair 12C. The front side (transfer surface S) of the label sheet P is slightly in contact with or slightly separated from the contact surface 66A in the vertical path 62B. Furthermore, the rear side of the label sheet P (release paper P3) is slightly in contact with or slightly separate from the inclined surface 64A in the inclined path 62A. As described above, according to the present exemplary embodiment, even when the label sheet P is transported by the transport roller pair 12C and transported in the nip N, adhering of the powder H to the transfer surface S of the label sheet P may be suppressed.

Figure 6B:
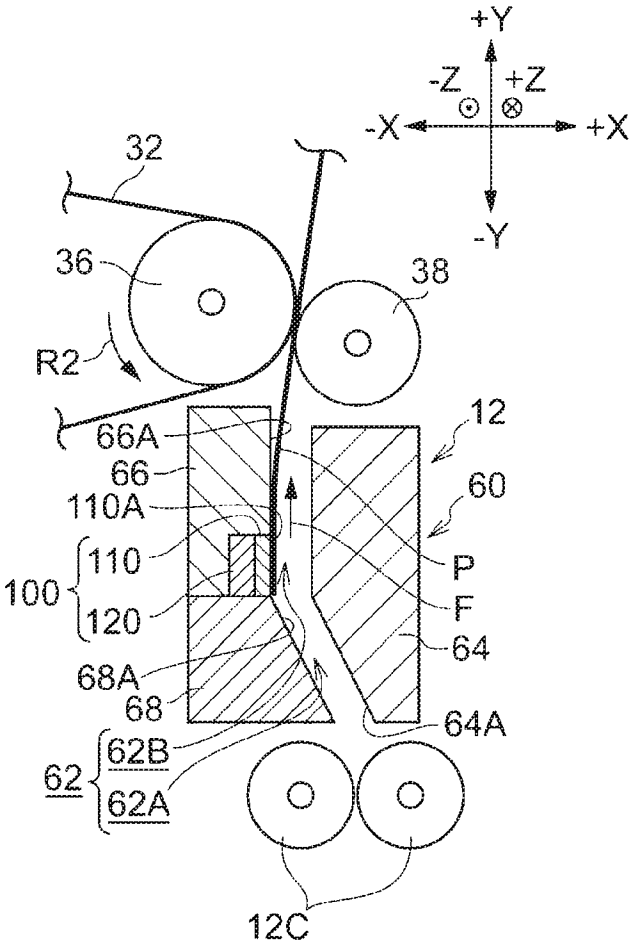
FIGS. 6A and 6B explain the operation of the transport device according to the first exemplary embodiment.
Figure 6A:
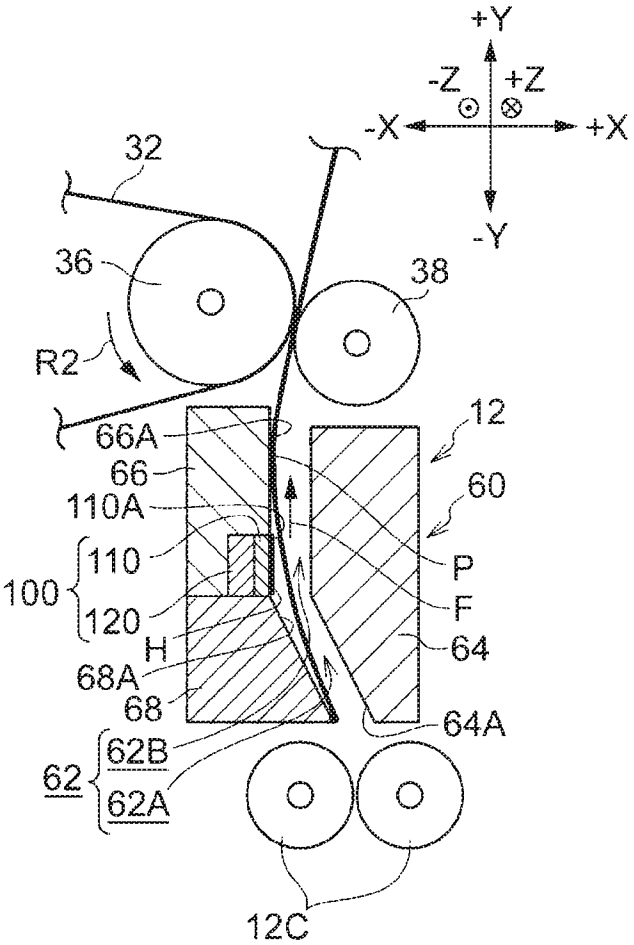

When the label sheet P is transported further in the transport direction F, the trailing end of the label sheet P is separated from the transport roller pair 12C and brought into contact with the inclined surface 68A of the second guide member 68 as illustrated in FIG. 6A. At this time, the label sheet P continues to be transported in the nip N. The front side (transfer surface S) of the label sheet P is slightly in contact with or slightly separated from the contact surface 66A in the vertical path 62B. Thus, according to the present exemplary embodiment, when the trailing end of the label sheet P is separated from the transport roller pair 12C, the transfer surface S of the label sheet P is able to be separated from the contact portion 110 by the second guide member 68. Compared to the case where the second guide member 68 is not provided, adhering of the powder H to the transfer surface S of the label sheet P may be suppressed.

Here, as described above, when the contact portion 110 excessively projects toward the guidance member 64 (+X side) relative to the contact surface 66A, that is, the contact portion 110 excessively projects in the guide path 62 (vertical path 62B), the powder H may adhere to the transfer surface S of the label sheet P. Accordingly, as described above as the condition 2, when seen in the width direction of the label sheet P (Z direction), the flat surface 110A may be disposed in the region T defined by the extended line L2 extended from the contact surface 66A toward the second guide member 68, the inclined surface 68A, and the label sheet P in contact with the contact surface 66A and the inclined surface 68A. This allows the contact portion 110 to be separated from the label sheet P transported toward the guide path 62 (vertical path 62B) compared to the case where the flat surface 110A is disposed outside the region T. Thus, adhering of the powder H to the transfer surface S of the label sheet P may be suppressed. Furthermore, this may allow the powder H to adhere to the glue extending outward to the leading end of the label sheet P.

When the label sheet P is transported further in the transport direction F, the trailing end of the label sheet P is separated from the second guide member 68, that is, removed from the inclined path 62A as illustrated in FIG. 6B. At this time, the label sheet P continues to be transported in the nip N. This causes the trailing end of the label sheet P to be brought into contact with the contact portion 110 in the vertical path 62B. This may allow the powder H to adhere to the glue extending outward to the trailing end of the label sheet P in the transport direction F.

Here, when the length of the contact portion 110 in the transport direction F (Y direction) is larger than the length D of the margin M on the trailing end side of the label sheet P, the powder H adheres to the image forming region A near the margin M on the trailing end side of the label sheet P. In contrast, according to the present exemplary embodiment to which the above-described condition 3 is applied, compared to the case where the length of the powder applying device 100 (contact portion 110) in the transport direction F (Y direction) is larger than the length D of the margin M on the trailing end side of the label sheet P, adhering of the powder H to the image forming region A near the margin M on the trailing end side of the label sheet P may be suppressed.

Thus, with the transport unit 12 according to the present exemplary embodiment, when the label sheet P is used, the following features may be obtained compared to the structure with which the powder H is not applied to the leading end and the trailing end of the label sheet P. That is, since the powder H is able to adhere to the leading end and the trailing end of the label sheet P, exposure of the glue at the leading end and the trailing end of the label sheet P may be suppressed. This may suppress adhering of the glue to the transfer belt 32, and accordingly, may suppress image defects. Furthermore, according to the present exemplary embodiment, since adhering of the powder H to the image forming region A where the images are formed is suppressed, transfer of the toner images G is not obstructed. That is, image defects to be formed may be suppressed.

Second Exemplary Embodiment

The powder applying device according to a second exemplary embodiment is differently structured from that of the first exemplary embodiment. The difference between the first exemplary embodiment and the second exemplary embodiment will be described. The same elements as those of the first exemplary embodiment are denoted by the same reference signs.

Figure 7:
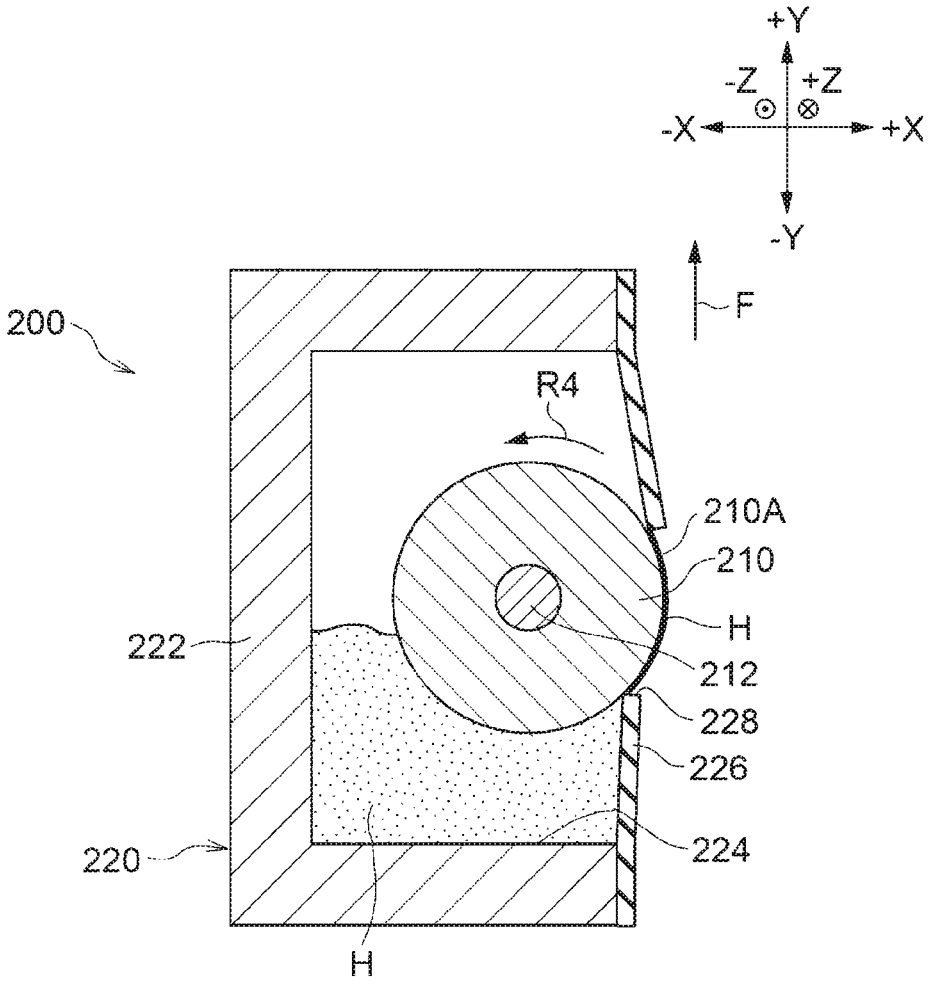
FIG. 7 is a structural view (sectional view) of a powder applying device of a transport device according to a second exemplary embodiment.

As illustrated in FIG. 7, a powder applying device 200 according to the second exemplary embodiment is provided in the width direction of the label sheet P (Z direction) in the cut portion 66B of the first guide member 66. This powder applying device 200 includes a contact portion 210 and a storing portion 220. The contact portion 210 has a cylindrical shape and is rotatable about the axis extending in the width direction of the label sheet P (Z direction). The powder H is stored in the storing portion 220. The contact portion 210 has a length in the width direction of the label sheet P (Z direction) equal to or larger than that of the label sheet P. A shaft 212 is inserted through a central portion of the contact portion 210. End portions of the shaft 212 in the width direction of the label sheet P (on the +Z side and the −Z side) are rotatably supported by wall portions of a container 222 of the storing portion 220. The guidance member 64 side of a cylindrical surface 210A, which serves as an example of a contact surface, of the contact portion 210 is exposed in the guide path 62 side (vertical path 62B). Although the contact portion 210 is formed of a sponge having an open cell structure and serving as a porous elastic body according to the present exemplary embodiment, this is not limiting as long as the powder H is able to be held and able to be applied to the leading end or the trailing end of the label sheet P at the cylindrical surface 210A. For example, the contact portion 210 may be formed of brush-shaped fiber member.

The storing portion 220 has an opening 224 on the guide path 62 side (+X side) and the container 222 having a box shape elongated in the width direction of the label sheet P (Z direction). The storing portion 220 is contained in the cut portion 66B. Furthermore, the contact portion 210 is contained in the container 222. Furthermore, a cover portion 226 is provided so as to cover the opening 224. The cover portion 226 has a gap 228 at its central portion in the Y direction. The contact portion 210 is disposed so as to close the gap 228 from which the cylindrical surface 210A of the contact portion 210 is exposed. In other words, the cover portion 226 covers the contact portion 210 so that the cylindrical surface 210A is exposed from the gap 228. The cover portion 226 is an elastic plate member, and a peripheral portion around the gap 228 is pressed against the cylindrical surface 210A.

Here, in the storing portion 220, the contact portion 210 is contained in a space defined by the container 222 and the cover portion 226, and the powder H is stored such that the powder H is in contact with the contact portion 210 (cylindrical surface 210A). The powder H is held on the cylindrical surface 210A of the contact portion 210 exposed from the gap 228.

Operation of the powder applying device 200 according to the second exemplary embodiment is as follows. That is, as illustrated in FIG. 5A, when the label sheet P is transported toward the powder applying device 200, the leading end of the label sheet P is brought into contact with the powder applying device 200. Specifically, the leading end of the label sheet P is brought into contact with the cylindrical surface 210A of the contact portion 210 of the powder applying device 200 exposed in the guide path 62. This may cause the powder H held on the cylindrical surface 210A to adhere to the glue extending outward to the leading end of the label sheet P. Furthermore, the contact portion 210 is rotated in the transport direction F (an arrow R4 direction illustrated in FIG. 7) when the leading end of the label sheet P is brought into contact with the contact portion 210. That is, according to the present exemplary embodiment, compared to a structure in which the contact portion 210 is not deformed or displaced, the likelihood of the label sheet P being caught by the contact portion 210 when the label sheet P is brought into contact with the powder applying device 200 may be reduced. As illustrated in FIG. 7, as a result of the rotation of the contact portion 210 in the arrow R4 direction, the powder H in the storing portion 220 is picked up by the contact portion 210 and a new portion of the cylindrical surface 210A to which the powder H adheres appears in the gap 228. That is, the storing portion 220 is able to supply the powder H when the contact portion 210 is a rotatable cylindrical body. According to the present exemplary embodiment, compared to a structure that is not provided with the storing portion 220, shortage in supply of the powder H may be suppressed.

According to the second exemplary embodiment, as is the case with the first exemplary embodiment, with the powder applying device 200 disposed in the guide unit 60 so as to satisfy the above-described conditions 1, 2, and 3, the features similar to those obtained with the first exemplary embodiment may be obtained. According to the second exemplary embodiment, the conditions 1, 2, and 3 are set for the cylindrical surface 210A of the contact portion 210 exposed from the gap 228.

Third Exemplary Embodiment

The second guide member 68 according to a third exemplary embodiment is differently structured from that of the first exemplary embodiment. The difference between the first exemplary embodiment and the third exemplary embodiment will be described. The same elements as those of the first exemplary embodiment are denoted by the same reference signs.

Figure 8:
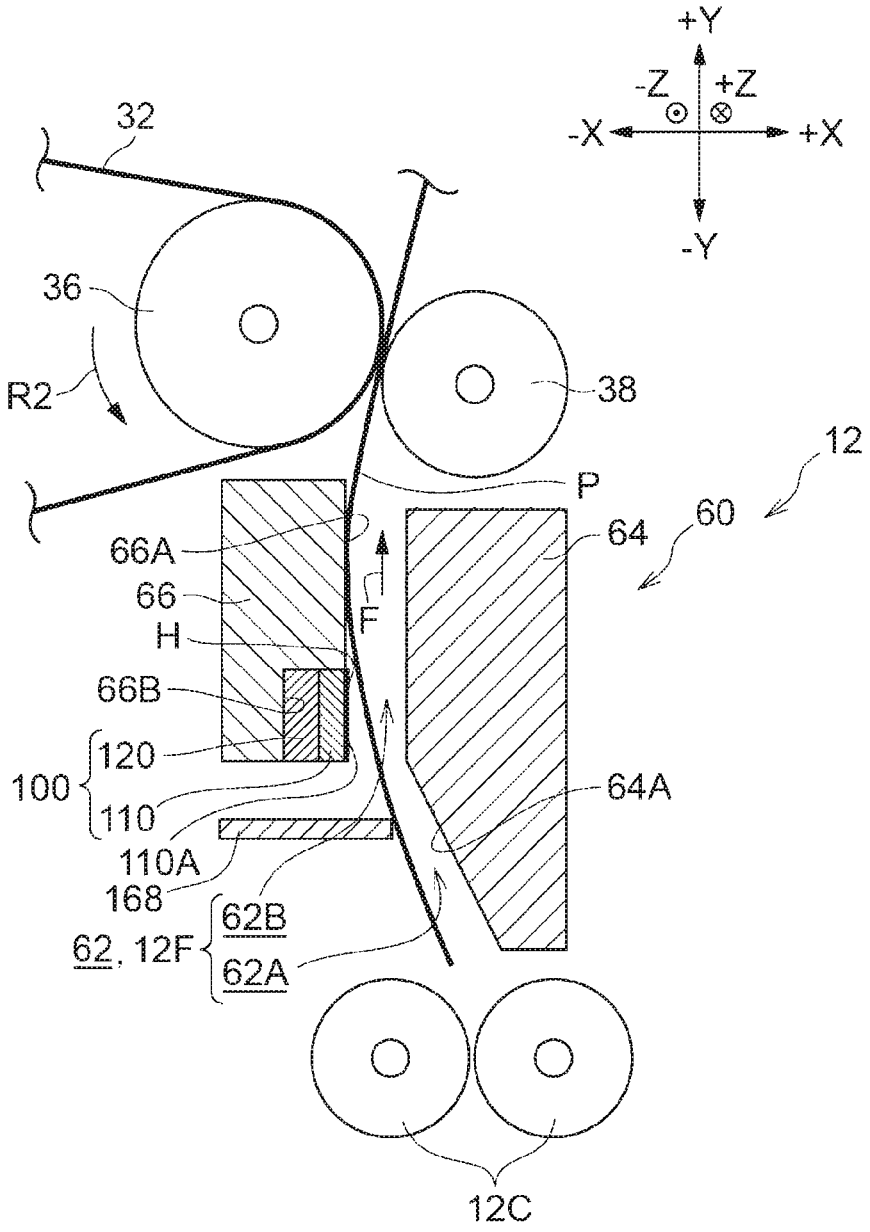
FIG. 8 is a structural view (sectional view) of a transport device according to a third exemplary embodiment.

As illustrated in FIG. 8, a second guide member 168 according to the third exemplary embodiment is a plate-shaped member having the thickness direction in the Y direction and extending in the Z direction. An end portion of the second guide member 168 on the +X side is positioned closer to the guidance member 64 side (+X side) than the contact surface 66A. With the second guide member 168 according to the third exemplary embodiment, the features similar to those obtained with the second guide member 68 of the first exemplary embodiment may be obtained. According to the third exemplary embodiment, when the trailing end of the label sheet P contact of which with the powder applying device 100 is regulated by the second guide member 168 passes through the second guide member 168, the trailing end of the label sheet P becomes able to be brought into contact with the contact portion 110. At this time, when the distance between an upper surface (surface on the +Y side) of the second guide member 168 and an upper end (end portion on the +Y side) of the contact portion 110 is equal to or smaller than the length D (see FIG. 2A) of the margin M at the trailing end of the label sheet P, adhering of the powder H to the image forming region A near the margin M on the trailing end side of the label sheet P may be suppressed.

Although the second guide member 168 is a single unit in the Y direction according to the present exemplary embodiment, this is not limiting. For example, plural second guide members 168 may be arranged along the inclined path 62A. Furthermore, it is sufficient that the second guide member project toward the guidance member 64 side. The second guide member is not limited to a plate-shaped member as in the present exemplary embodiment. For example, a cylindrical body having the axial direction in the Z direction may be disposed closer to the guidance member 64 side (+X side) than the contact surface 66A of the first guide member 66. Alternatively, plural bar members projecting toward the +X side may be arranged in the Z direction.

Fourth Exemplary Embodiment

The disposition of the powder applying device and the structures of the first guide member and the second guide member according to a fourth exemplary embodiment are different from those of the first exemplary embodiment. The difference between the first exemplary embodiment and the fourth exemplary embodiment will be described. The same elements as those of the first exemplary embodiment are denoted by the same reference signs.

Figure 9:
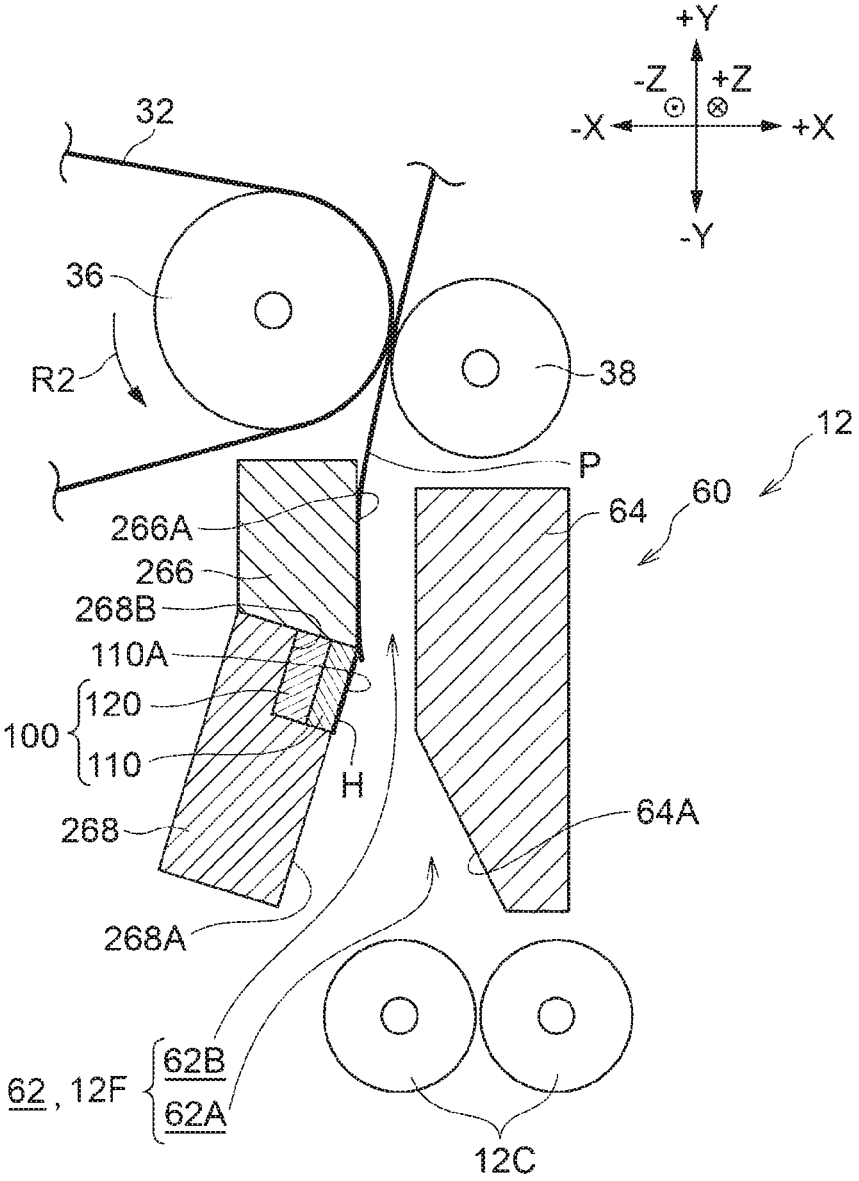
FIG. 9 is a structural view (sectional view) of a transport device according to a fourth exemplary embodiment.

As illustrated in FIG. 9, a first guide member 266 according to the fourth exemplary embodiment is provided at a position on the side facing the guidance member 64 and downstream of the powder applying device 100 in the transport direction F. The first guide member 266 is an elongated member having a trapezoidal section in sectional view seen in the width direction of the label sheet P (Z direction). The first guide member 266 has a function of regulating contact between the label sheet P and the powder applying device 100. Here, the first guide member 266 has a contact surface 266A extending in the Y direction. The label sheet P is brought into contact with the contact surface 266A.

The second guide member 268 according to the fourth exemplary embodiment is an elongated member having a rectangular cut portion 268B at a corner portion on the +X side of the +Y side thereof in sectional view seen in the width direction of the label sheet P (Z direction). Here, the second guide member 268 has an inclined surface 268A inclined such that the distance (X direction) between the second guide member 268 and the guidance member 64 increases toward the lower side (−Y side) of the guidance member 64 (+X side). This inclined surface 268A allows the leading end of the label sheet P to be guided therethrough. Furthermore, the width of the second guide member 268 (the length in a direction perpendicular to the inclined surface 268A) is equal to the length of a side of the first guide member 266 at an end portion on the −Y side. The powder applying device 100 is contained in the cut portion 268B of the second guide member 268.

The powder applying device 100 according to the present exemplary embodiment is provided further to the +Y side than an end portion of the inclined surface 64A of the guidance member 64 on the +Y side. Furthermore, the contact portion 110 of the powder applying device 100 is provided further to the −X side than the contact surface 266A of the first guide member 266.

According to the fourth exemplary embodiment, the powder H may adhere to the glue extending outward to the leading end of the label sheet P. Furthermore, since the contact portion 110 is provided further to the −X side than the contact surface 266A, adhering of the powder H to the transfer surface S (image forming region A) of the label sheet P may be suppressed.

Notes

Although the first guide member 66 and the second guide member 68 are separately formed according to the first exemplary embodiment, this is not limiting. The first guide member 66 and the second guide member 68 may be integrally formed. Furthermore, in addition to the first guide member 66 and the second guide member 68, the guidance member 64 may be integrally formed with the first guide member 66 and the second guide member 68. This is also applicable to the other exemplary embodiments than the first exemplary embodiment.

Although the toner images G of the colors developed by the respective image forming units 20 are transferred onto the label sheet P through the transfer belt 32 in the above-described exemplary embodiments, this is not limiting. The toner images G may be directly transferred onto the label sheet P. Furthermore, although the image forming apparatus is for forming toner images of multiple colors according to the above-described exemplary embodiments, this is not limiting. Techniques described herein may be used for an image forming apparatus for forming toner images of a single color (for example, black (K)). In the above-described cases, the transport device transports the label sheet P toward the photosensitive drum 22 serving as an example of the image holding body.

For the exemplary embodiments, a switching device may be provided. With this switching device, whether or not to use the powder applying device 100 or 200 is switched in accordance with the type of the recording medium. The switching device may, for example, physically change the path from the guide path 62 to another path. Alternatively, a shutter may be provided on the guide path 62 side of the contact portion 110 or 210. Alternatively, the powder applying device 100 or 200 may be removed and an elongated member (dummy) formed of resin may be mounted in the cut portion 66B or 268B. With the switching device, application of the powder H is able to be stopped when recording paper such as plain paper is used as the recording medium.

For the exemplary embodiments, the powder applying device 100 or 200 may be irreplaceable. In this case, the storing portion 120 or 220 is filled with a sufficient amount of the powder H so that the powder H is not exhausted in the life of the apparatus. Instead, for the exemplary embodiments, the powder applying device 100 or 200 may be replaceable. In this case, only the storing portion 120 may be replaced with a new storing portion 120 for the powder applying device 100 according to the first, third, and fourth exemplary embodiments, or the powder applying device 100 itself may be replaced with a new powder applying device 100. Furthermore, regarding the powder applying device 200 according to the second exemplary embodiment, the storing portion 220 may be replenished with the powder H, or the powder applying device 200 itself may be replaced with a new powder applying device 200.

Although the sheet onto which the toner images G are transferred is the label sheet P that includes the tacky layer P2 to which the glue is applied according to the exemplary embodiments, the sheet usable with the techniques herein is not limited to the label sheet P. For example, the techniques herein may be used for coated paper formed by coating the surface of plain paper with resin or the like. Also with the coated paper, image defects may occur or the cleaning performance may be adversely affected when the resin on the surface of the coated paper is removed and adheres to the transfer belt 32. Accordingly, by causing the powder H to adhere to the leading end and the trailing end of the coated paper in the transport direction F, adhering of the resin on the surface of the coated paper to the transfer belt 32 may be suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device, comprising:

a powder applying device that is provided in a guide path configured to guide a sheet toward an image holding body configured to hold a toner image to be transferred onto the sheet, wherein the powder applying device is configured to apply powder to an end portion of a transfer surface of the sheet for the toner image in a transport direction of the sheet, wherein the end portion is provided in a central portion in a width direction of the sheet, and wherein the width direction is orthogonal to the transport direction.

2. The transport device according to claim 1, wherein the powder applying device includes a contact portion configured to contact the sheet in a width direction of the sheet, and wherein the contact portion is a porous elastic body.

3. The transport device according to claim 1, wherein the powder applying device includes a contact portion that is rotatable about an axis extending in a width direction of the sheet, and wherein the contact portion is a cylindrical body configured to contact the sheet.

4. The transport device according to claim 1, wherein the transport device further includes a regulating member that is provided downstream of the powder applying device in the transport direction, and wherein the regulating member is configured to regulate contact between the powder applying device and a transfer surface of the sheet for the toner image.

5. The transport device according to claim 4, wherein the transport device further includes another regulating member that is provided upstream of the powder applying device in the transport direction, and wherein the another regulating member is configured to regulate contact between the powder applying device and the transfer surface of the sheet.

6. The transport device according to claim 5, wherein the powder applying device has a first surface configured to contact the sheet, wherein the regulating member has a second surface configured to contact the sheet, and wherein, when seen in a width direction of the sheet, the first surface is disposed in a region defined by an extended line extended from the second surface toward the other regulating member, an outer line of the other regulating member, and the sheet.

7. The transport device according to claim 4, wherein the transport device further includes another regulating member that is provided upstream of the powder applying device in the transport direction.

8. The transport device according to claim 4, wherein a length of the powder applying device in the transport direction is equal to or smaller than a length of a margin set on an upstream side of the sheet in the transport direction.

9. The transport device according to claim 1, wherein the transport device further includes a regulating member which is provided downstream of the powder applying device so as to be adjacent to the powder applying device in the transport direction, and wherein the regulating member is configured to contact the sheet.

10. An image forming apparatus comprising:

an image holding body configured to hold a toner image formed by developing an electrostatic latent image; and the transport device according to claim 1.

11. The transport device according to claim 1, wherein the transport device further includes a suppressing member configured to suppress adhering of the powder to a transfer surface of the sheet for the toner image.

12. A transport device, comprising:

a powder applying means, provided in a guide path configured to guide a sheet toward an image holding body configured to hold a toner image to be transferred onto the sheet, for applying powder to an end portion of a transfer surface of the sheet for the toner image in a transport direction of the sheet, wherein the end portion is provided in a central portion in a width direction of the sheet, and wherein the width direction is orthogonal to the transport direction.

13. A transport device, comprising:

a powder applying device that is provided in a guide path configured to guide a sheet toward an image holding body configured to hold a toner image to be transferred onto the sheet, wherein the powder applying device is configured to apply powder to an end portion of the sheet in a transport direction of the sheet, wherein the end portion is provided in a central portion in a width direction of the sheet, and wherein the width direction is orthogonal to the transport direction.

14. The transport device according to claim 13, wherein a width of the powder applying device in the width direction is equal to or greater than a width of the sheet in the width direction.

15. The transport device according to claim 13, wherein the transport device further includes a regulating member that is provided downstream of the powder applying device in the transport direction, and wherein the regulating member is configured to regulate contact between the powder applying device and a transfer surface of the sheet for the toner image.

16. The transport device according to claim 13, wherein the transport device further includes a suppressing member configured to suppress adhering of the powder to a transfer surface of the sheet for the toner image.

17. The transport device according to claim 13, wherein the end portion extends across an entire width of the sheet in the width direction.

* * * * *